US008783086B2

(12) United States Patent
Hirano

(10) Patent No.: US 8,783,086 B2
(45) Date of Patent: Jul. 22, 2014

(54) METHOD FOR PRODUCING GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 259 days.

(21) Appl. No.: 13/301,218

(22) Filed: Nov. 21, 2011

(65) Prior Publication Data

US 2012/0125073 A1 May 24, 2012

(30) Foreign Application Priority Data

Nov. 22, 2010 (JP) ..... 2010-260339

(51) Int. Cl.
*B21D 31/00* (2006.01)

(52) U.S. Cl.
USPC ..... 72/379.2

(58) Field of Classification Search
USPC ..... 72/379.2; 473/324
See application file for complete search history.

(56) References Cited

U.S. PATENT DOCUMENTS 7,281,993 B2 * 10/2007 Oyama ..... 473/345
7,470,201 B2 * 12/2008 Nakahara et al. ..... 473/345

FOREIGN PATENT DOCUMENTS

JP 2004-283543 A 10/2004
JP 2005-52458 A 3/2005
JP 2005-58634 A 3/2005
JP 2005-66148 A 3/2005

* cited by examiner

*Primary Examiner* — Teresa M Ekiert
(74) *Attorney, Agent, or Firm* — Birch, Stewart, Kolasch & Birch, LLP

(57) ABSTRACT

A golf club head has a hollow structure comprising a head main body provided with a opening and a cover covering the opening. The head main body is made of a metal material and provided in the opening with a supporting part for supporting a peripheral edge part of the cover fitted in the opening. The cover is made of a low specific gravity material. A method for producing the golf club head comprises a step of preparing a first workpiece having an opening, which step comprises forming the supporting part through a press working of a sheet metal having a uniform thickness.

4 Claims, 6 Drawing Sheets

METHOD FOR PRODUCING GOLF CLUB HEAD

BACKGROUND OF THE INVENTION

The present invention relates to a method for producing a golf club head, more particularly to a method for producing a hollow golf club head having an opening capable of reducing the mass of the golf club head and improving the durability of a junctional portion between a metallic head main body and a cover for the opening made of a low specific gravity material.

In order to lower the center of gravity of a wood-type hollow golf club head, there has been proposed a head (a) which is, as shown in FIG. 6(*a*), composed of a head main body (c) made of a metal material and provided with a crown opening (b), and a crown cover (d) covering the crown opening (b) and made of a material having a lower specific gravity than that of the head main body. The head main body (c) is provided with a supporting part (f) for supporting a peripheral edge part (e) of the crown cover (d). The head main body (c) is produced by a lost-wax casting method from a viewpoint of the production efficiency.

In the lost-wax casting method, however, as shown in FIG. 6(*b*) which is a cross sectional view taken along line D-D of FIG. 6(*a*), in order to make it easy to remove the core (not shown) used to form a wax model, an internal corner (h) between the supporting part (f) and the inner surface (c1) of the head main body (c) has to be rounded, and thereby the round portion is increased in the thickness.

Thus, in the case of the head main body (c) produced by such lost wax casting method, the mass of the golf club head is increased due to the increased thickness, and the design freedom of the center of gravity of the head is decreased.

Further, between the peripheral edge part (e) and the supporting part (f), a region having a higher rigidity is formed due to the increased thickness, therefore, cracks are liable to occur in the junctional portion between the head main body (c) and the crown cover (d), and the durability of the golf club head in particular the crown portion is deteriorated.

SUMMARY OF THE INVENTION

It is therefore, an object of the present invention to provide a method for producing a golf club head, by which the redundant mass due to the rounded internal corner can be eliminated to reduce the mass, and the increase in the rigidity in the junctional portion can be avoided to improve the durability.

According to the present invention, provided is a method for producing a golf club head having a hollow structure and including:

a head main body that is made of a metal material and has an opening; and a cover that is provided to cover the opening of the head main body and is made of a low-specific-gravity material having a lower specific gravity than the metal material, and the method comprises a step of preparing a first workpiece having the opening, the step of preparing a first workpiece including pressing a sheet material having a uniform thickness to form a supporting part around the opening, the supporting part being recessed stepwise from a head finished surface for supporting a peripheral edge portion of the cover.

Therefore, the internal corner formed in the vicinity of the supporting part maintains the uniform thickness, and the redundant mass due to the rounded internal corner in the prior art golf club head can be removed and a weight reduction of the club head is possible. Further, in the junctional portion, the rigidity difference or variation is reduced, and the durability can be improved.

The above-mentioned first workpiece can be a crown member that forms a crown portion defining the upper surface of the golf club head and has an opening in the crown portion, and the cover can be made of a fiber-reinforced resin material.

Further, it is possible that a rigidity index GA of the cover which is defined as a product of a tensile strength $\sigma$1 of the cover and the thickness t1 of the cover measured in the peripheral edge part supported by the supporting part is 0.45 to 0.80 times a rigidity index GB of the supporting part of the head main body which is defined as a product of a tensile strength $\sigma$2 of the supporting part and the thickness t2 of the supporting part.

Furthermore, it is possible that the supporting part of the head main body has a supporting face denting from and being parallel with the outer surface of the head main body around the opening and a slant face extending from said outer surface to said supporting face while inclining to the opening, wherein the supporting part has a thickness ta of from 0.5 to 1.5 mm at the intersection between the slant face and said outer surface, and the thickness ta is 0.8 to 1.8 times a thickness tb of the supporting part measured at the edge of the supporting face adjacent to the opening.

Definitions

In this application including the description and claims, dimensions, positions, directions and the like relating to the club head refer to those under a standard state of the club head unless otherwise noted.

Here, the standard state of the club head is such that the club head is set on a horizontal plane HP so that the axis of the club shaft (not shown) is inclined at the lie angle while keeping the axis on a vertical plane, and the club face forms its loft angle with respect to the horizontal plane HP. Incidentally, in the case of the club head alone, the center line of the shaft inserting hole can be used instead of the axis of the club shaft.

The undermentioned "front-back direction" of the head is a direction parallel with a straight line N projected on the horizontal plane HP, wherein the straight line N is drawn normally to the club face passing through the center of gravity of the club head.

BRIEF DESCRIPTION OF THE DRAWINGS

FIG. 2(*b*) is an exploded view of part B in FIG. 2(*a*).

FIG. 6(*b*) is a cross sectional view taken along line D-D of FIG. 6(*a*).

DESCRIPTION OF THE PREFERRED EMBODIMENTS

Embodiments of present invention will now be described in detail in conjunction with accompanying drawings.

Figure 1:
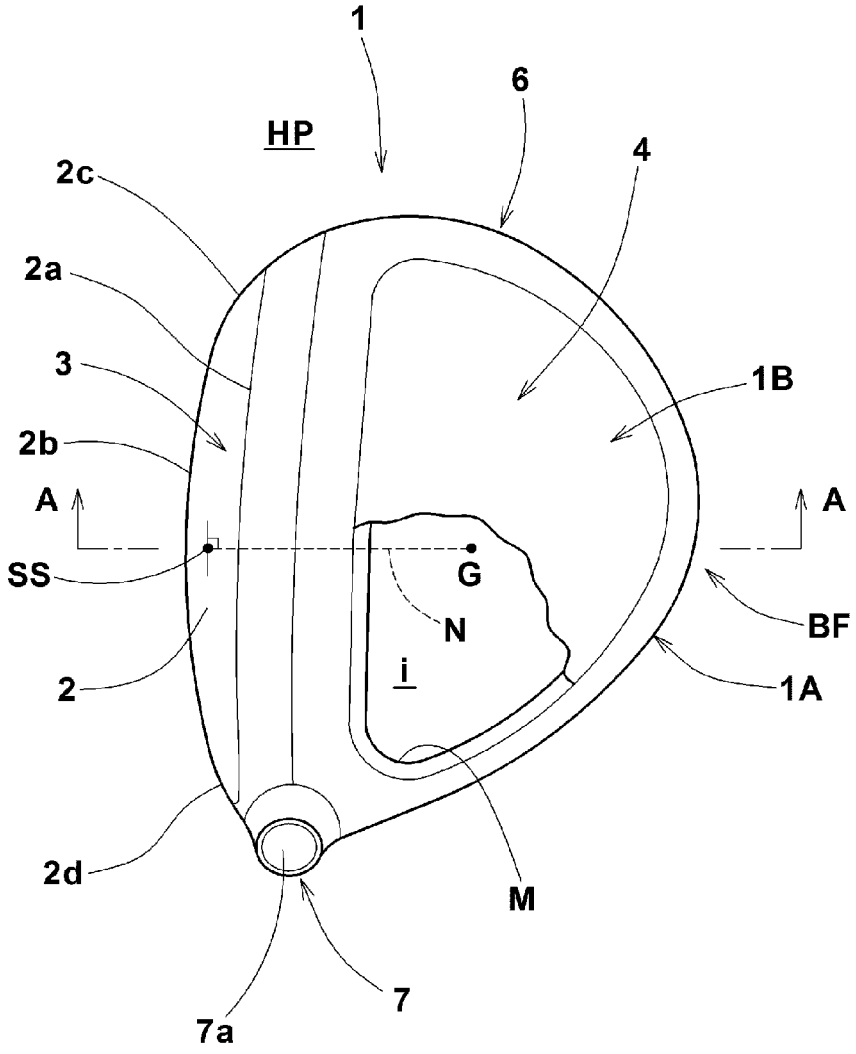
FIG. 1 is a top view of a golf club head produced by a method according to the present invention.
Figure 2A:
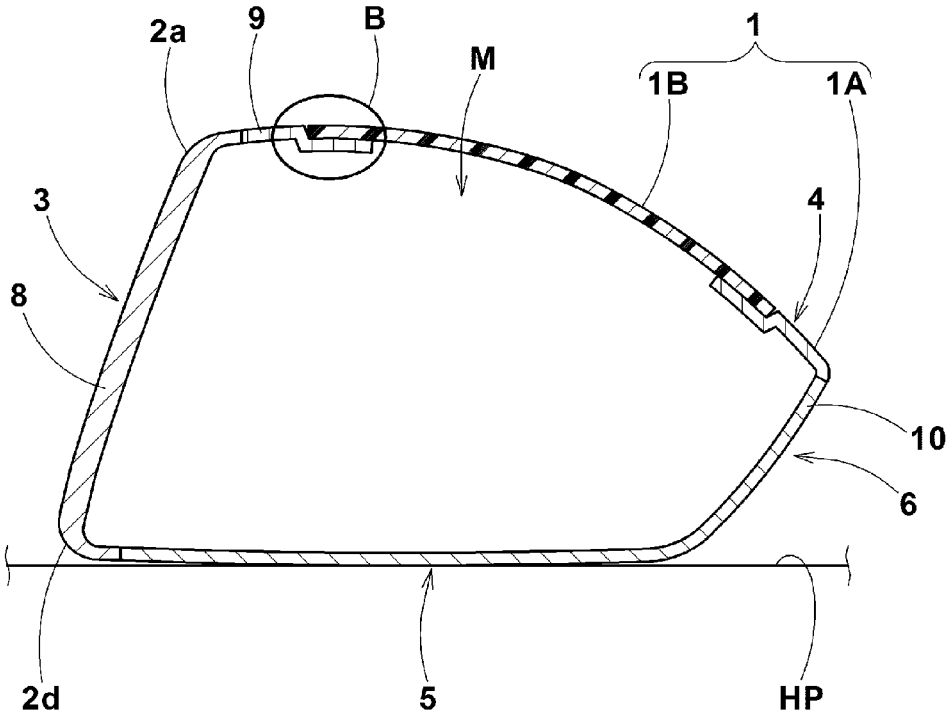
FIG. 2(*a*) is a cross sectional view taken along line A-A of FIG. 1.
Figure 2B:
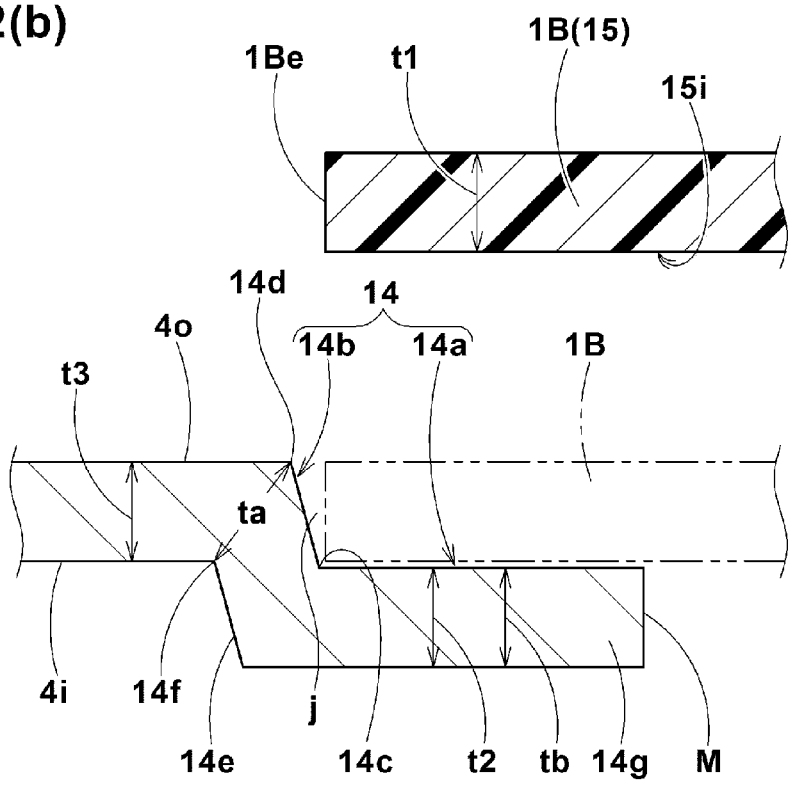

As shown in FIG. 1 and FIG. 2(*a*), a golf club head 1 produced by a method according to the present invention is a hollow head for a wood-type golf club such as driver (#1) or fairway wood, and the head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 positioned at the heel side end of the crown portion to be attached to an end of a club shaft (not shown) inserted into a shaft inserting hole 7*a*. Thus, the club head 1 is provided with a hollow (i) and a shell structure with the thin wall.

In the case of a wood-type club head for a driver (#1), it is preferable that the head volume is set in a range of not less than 400 cc, more preferably not less than 420 cc in order to increase the moment of inertia and the depth of the center of gravity to thereby improve the directionality of the ball. However, to prevent an excessive increase in the club head mass and deteriorations of swing balance and durability, it is preferable that the head volume is not more than 480 cc, more preferably not more than 470 cc.

The mass of the club head 1 is preferably set in a range of not less than 175 g, more preferably not less than 180 g in view of the swing balance, but not more than 210 g, more preferably not more than 205 g in view of the directionality and traveling distance of the ball.

The club head 1 has a head main body 1A provided with an opening M, and a cover 1B attached to the head main body 1A so as to cover the opening M.

The opening M may be provided in various positions, for example, within the crown portion 4 or side portion 6 or sole portion 5. Further, the opening M may protrude from one portion to the adjacent portion, for example, from the crown portion 4 to the side portion 6.

The head main body 1A is made of one or more kinds of metal materials having high specific strength, e.g. pure titanium, titanium alloys, aluminum alloys, stainless steels and the like.

Figure 3:
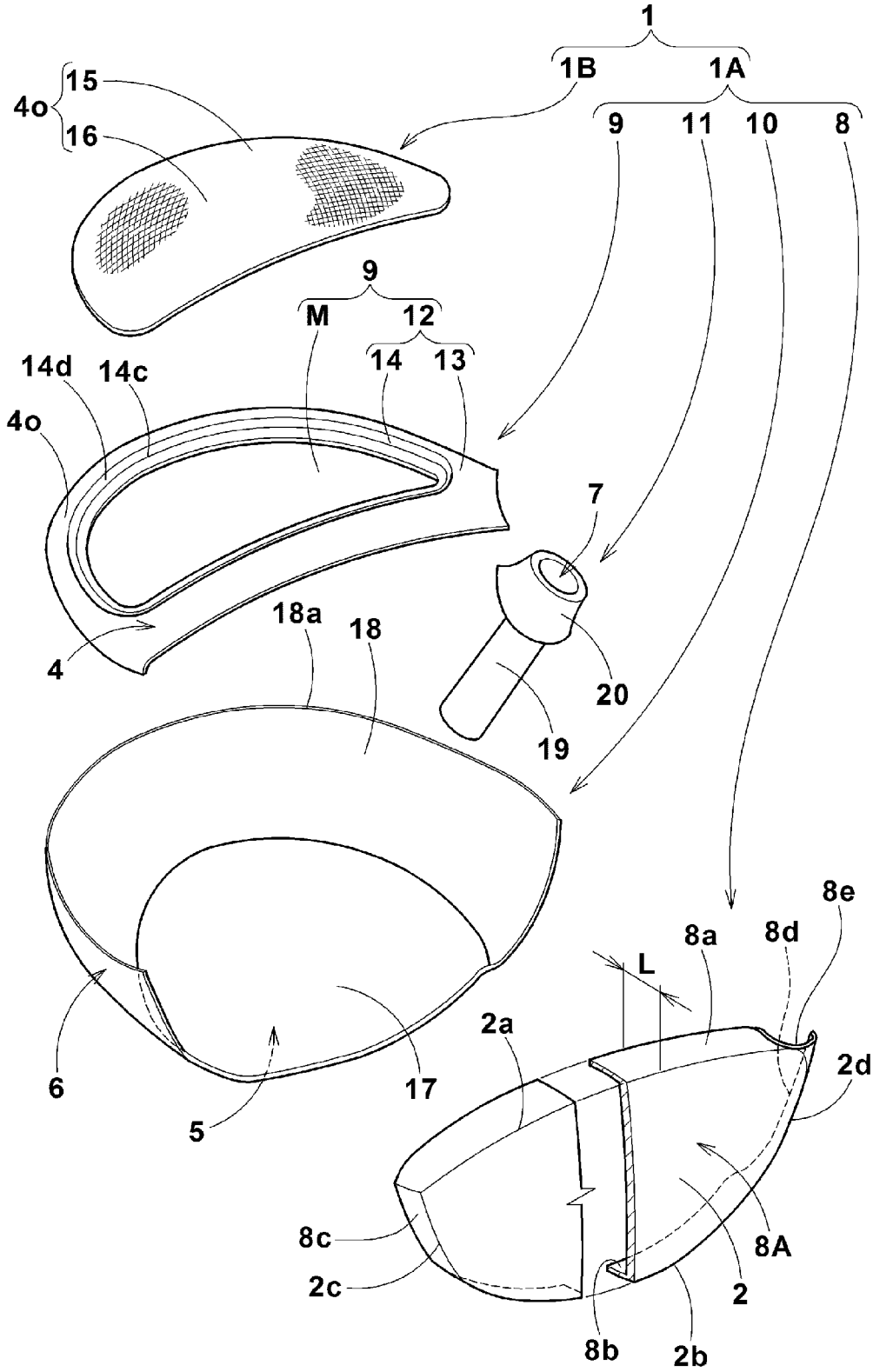
FIG. 3 is an exploded perspective view showing an example of the hollow structure of the golf club head.

In this embodiment, as shown in FIG. 3, the head main body 1A is formed as a four-piece structure composed of
a face member 8 forming the face portion 3,
a crown member 9 forming a part of the crown portion 4,
a sole side member 10 forming the almost entire part of the sole portion 5 and side portion 6, and
a hosel member 11 forming the hosel portion 7.

The face member 8 in this embodiment is composed of a face plate 8A defining the entirety of the face portion 3, and a turnback extending backwardly of the club head from the edge of the club face 2, excepting the part 8*e* interfering the hosel portion 7. In other words, a cutout part 8*e* is formed at a position corresponding to that of the hosel portion 7.

Thus, the turnback in this embodiment is made up of a crown-side turnback 8*a*, a sole-side turnback 8*b*, a toe-side turnback 8*c* and a heel-side turnback 8*d* which extend backwardly from the edges 2*a*, 2*b*, 2*c* and 2*d* of the club face 2, respectively, so as to form fore parts of the crown portion, sole portion and side portion. Accordingly, the head main body 1A in this embodiment forms the remaining aft parts of the crown portion, sole portion and side portion.

Preferably, the dimension L of the turnback (8*a*-8*d*) measured in the front-back direction from the edge (2*a*-2*d*) of the club face 2 to the rear edge of the turnback is set in a range of not less than 5 mm, more preferably not less than 8 mm, but not more than 30 mm, more preferably not more than 20 mm in order to distance the connection (in this embodiment, weld junction) between the face member 8 and the head main body 1A from the face portion 3 subjected to large stress and strain and thereby to improve the durability.

In this embodiment, the crown member 9 is provided with the above-mentioned opening M. Further, the opening M in this example is positioned within the crown portion 4. Therefore, the crown member 9 is annular, and forms a peripheral part 12 of the crown portion 4 surrounding the crown opening M. It is desirable that the opening M has a contour shape similar to the contour shape of the crown portion 4 so that the crown member 9 has almost constant width in view of the durability.

In order to obtain durability and a weight reduction in a well balanced manner, the area of the opening M is preferably set in a range of not less than 40 sq. cm, more preferably not less than 45 sq. cm, but not more than 80 sq. cm, more preferably not more than 75 sq. cm. Here, the area of the opening M means the area projected on the above-mentioned horizontal plane HP in the top view of the club head 1 under the standard state as shown in FIG. 1.

The crown member 9 comprises
a main portion 13 of which outer surface becomes a part of the outer surface 4*o* of the crown portion 4, and
a supporting part 14 recessed stepwise from a head finished surface or the outer surface 4*o* and supporting the peripheral edge part 15 of the cover 1B.

The supporting part 14 in this embodiment is formed continuously along the edge of the opening M so as to steadily support the cover 1B and also to provide rigidity for the peripheral part 12.

As shown in FIG. 2(*b*), the supporting part 14 has a supporting face 14*a* substantially parallel with the outer surface 4*o* and denting therefrom so as to contact with the inner surface 15*i* of the peripheral edge part 15.

Further, the supporting part 14 has a slant face 14*b*.

In order to facilitate the positioning of the cover 1B, the slant face 14*b* extends from the outer surface 4*o* to the supporting face 14*a* while inclining to the opening M, and the line of intersection 14*d* of the slant face 14*b* and the outer surface 4*o* describes a shape similar to but slightly larger than the contour shape of the cover 1B.

Incidentally, the resultant outwardly-increasing gap j between the slant face 14*b* and the edge 1Be of the cover 1B placed on the supporting face 14*a* is filled with an adhesive agent.

The above-mentioned sole side member 10 comprises, as shown in FIG. 3, a sole wall 17 forming the above-mentioned aft part of the sole portion 5, and a side wall 18 forming the above-mentioned aft part of the side portion 6.

The side wall 18 extends upwardly from an edge of the sole wall 17, and the upper edge 18*a* thereof is connected to the crown member 9.

The hosel member 11 has an umbrella shape and a center hole as the shaft inserting hole 7*a*. The hosel member 11 comprises an upper part 20 positioned outside the club head and having an outer surface which merges into the outer surface of the crown member 9, and a tubular extension part 19 extending inward of the head.

The cover 1B forms a major part of the outer surface 4*o* of the crown portion 4. The cover 1B has the above-mentioned peripheral edge part 15 supported by the supporting part 14 of the head main body 1A, and a main part 16 surround by the peripheral edge part 15. The cover 1B has a contour shape slightly smaller than the shape of the line of intersection 14*d*. As explained above, since the cover 1B is made of a low specific gravity material having a specific gravity less than that of the metal material of the head main body (in this embodiment, the crown member 9), this facilitates weight reduction of the club head and lowering of the center of gravity of the club head. As for the material of the cover 1B, titanium alloys, aluminum alloys, magnesium alloys, fiber reinforced resin and the like can be suitably used alone or in combination.

In this embodiment, a fiber reinforced resin, namely, a composite material of a matrix resin and reinforcing fibers is used. As to the matrix resin, for example, a thermosetting resin, e.g. epoxide resin, phenol resin and the like, or a thermoplastic resin, e.g. nylon resin, polycarbonate resin and the like can be used. As to the reinforcing fibers, for example, organic fibers, e.g. carbon fibers, glass fibers, aramid fibers, poly-phenylene-benzoxazole resin fibers (no fiber); metal fibers, e.g. amorphous fibers, titanium fibers and the like can be used. In particular, carbon fibers having high tensile strength and a low specific gravity are suitably used.

According to the invention, the golf club head 1 is produced as follows.

Firstly, the above-mentioned head main body 1A and the cover 1B are made.

The making of the head main body 1A includes:

making of a first workpiece having the opening M which, in this embodiment, corresponds to the crown member 9;

making of a second workpiece which corresponds to the head main body 1A except for the first workpiece (crown member 9) and which, in this embodiment, corresponds to the above-mentioned face member 8, sole side member 10 and hosel member 11; and joining the first workpiece to the second workpiece.

The making of the first workpiece, namely, the crown member 9 includes: forming the supporting part 14 by press working of a sheet metal having a uniform thickness.

As to the sheet metal, suitably used is a rolled sheet metal T formed by passing the material through between rotating mill rolls and thereby reducing the sectional area or thickness thereof to a desired constant thickness because, due to the work hardening, the material can be improved in mechanical characteristics, and provided with a crystalline structure with less crystal defects, and thereby it becomes possible to reduce the thickness and mass of the first workpiece or the crown member 9.

Figure 4A:
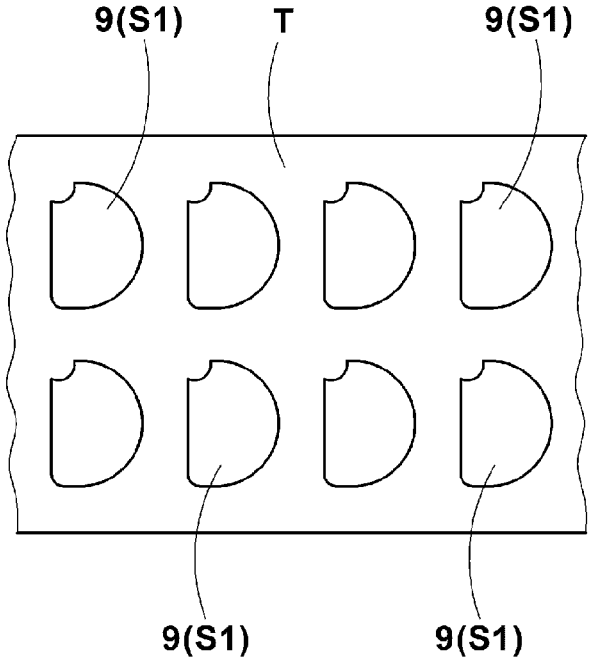
FIG. 4(*a*) is a diagram and FIG. 4(*b*) is a cross sectional view for explaining a method for preparing a crown member from a rolled sheet metal.
Figure 4B:
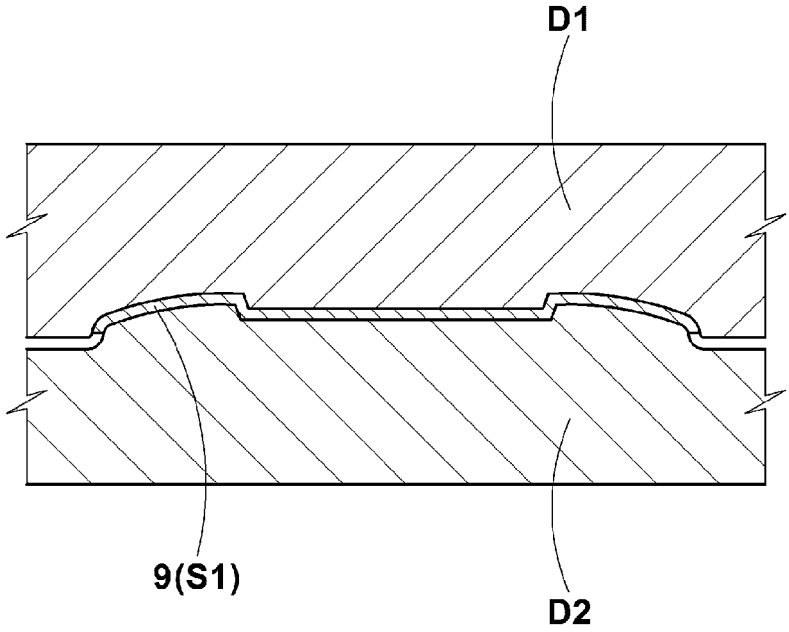

From the rolled sheet metal T, as shown in FIG. 4(*a*), a part S1 for forming the crown member 9 is cut out.

The cutout part S1 has a contour shape almost same as that of the crown member 9. Specifically, the contour shape may include a cutting stock around the part S1.

The cutting can be made by a suitable method, for example, laser cutting, punching by the use of cutting dies, or the like.

Then, as shown in FIG. 4(*b*), from the cutout part S1, the crown member 9 is formed by a hot press working technique.

In this hot press working process, the cutout part S1 is pressed between a male die D1 and a female die D2 in order to form the supporting part 14. In this stage, the opening M is not yet formed in the crown member 9. And the thickness t3 of the crown member 9 at the outer surface 4*o* (see FIG. 2(*b*)) is set in a range of not less than 0.40 mm, preferably not less than 0.45 mm, but not more than 1.3 mm, preferably not more than 1.2 mm.

Thereafter, for example, by means of laser cutting, the crown member 9 is provided with the opening M. Further, if needed, the edge of the opening M is trimmed to adjust the contour shape of the opening M.

Figure 6A:
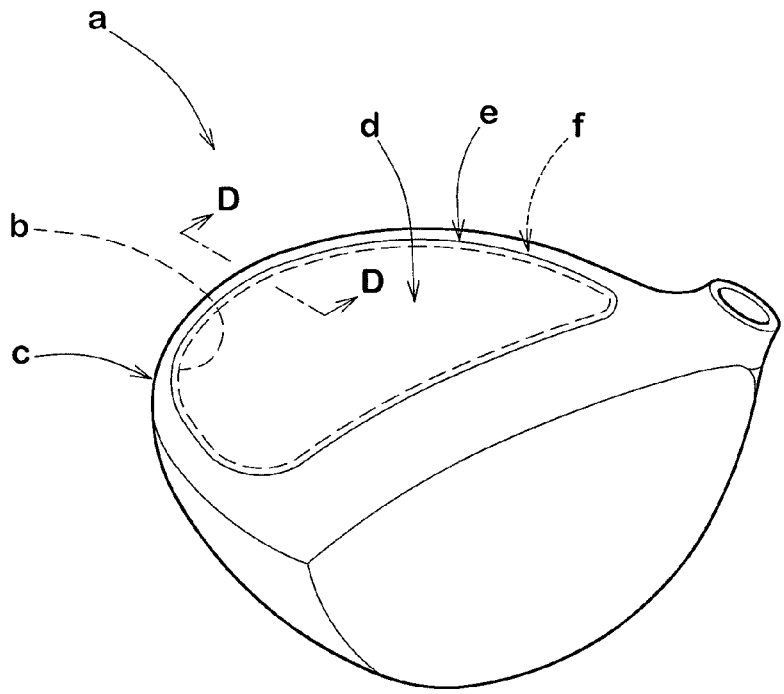
FIG.6(a) Prior Art
FIG. 6(*a*) is a perspective view of a club head according to the prior art.
Figure 6B:
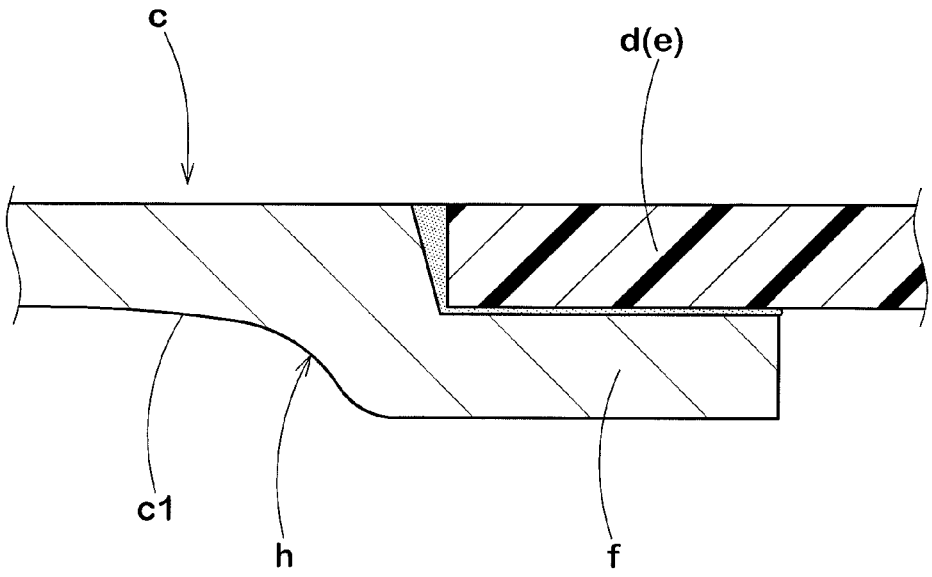
FIG.6(b) Prior Art

In the supporting part 14 formed as explained above, the thickness becomes uniform as shown in FIG. 2(*b*), and it is not necessary to round the internal corner (h) between the supporting part (f) and the inner surface (c1) of the head main body (c) as shown in FIG. 6(*b*). Therefore, the mass can be reduced. Further, the rigidity difference or variation is reduced, and the durability is improved.

The second workpiece which in this embodiment corresponds to the face member 8, the sole side member 10 and the hosel member 11, can be produced by various methods.

In view of the working efficiency and accuracy, it is preferable to form the face member 8 and sole side member 10 by means of press working. On the other hand, it is preferable that the hosel member 11 is formed from a round-bar material by cutting work using a NC lathe for example.

In this embodiment, similar to the crown member 9, the face member 8 is produced such that a part (not shown) for forming the face member 8 is cut out from a rolled sheet metal, and then the cutout part is pressed between a pair of dies to form the turnback and to provide a face roll and a face bulge. Also, the sole side member 10 is produced such that a part (not shown) for forming the sole side member 10 is cut out from a rolled sheet metal, and then the cutout part is pressed between a pair of dies to form the sole wall 17 and the side wall 18.

Then, the crown member 9, face member 8, sole side portion 10 and hosel member 11 are assembled, and in this embodiment, they are welded each other to form the head main body 1A.

Figure 5:
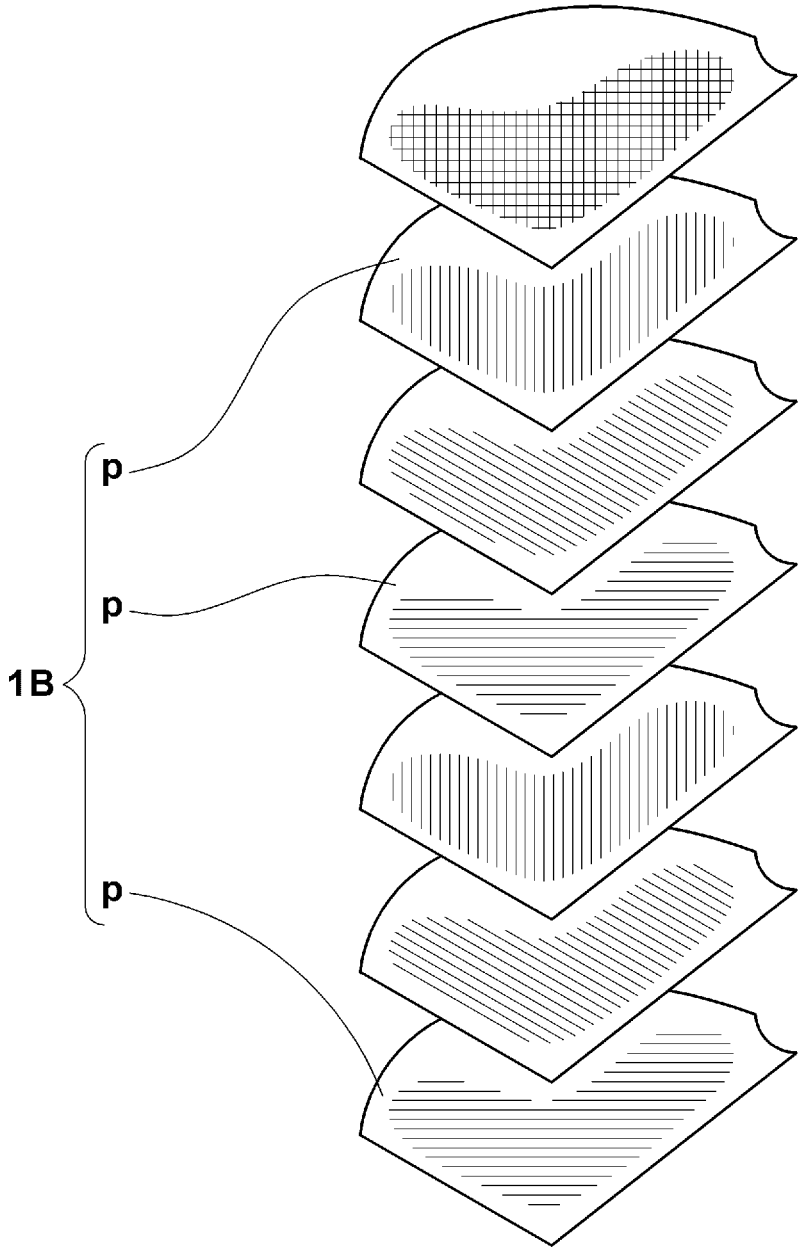
FIG. 5 is an exploded perspective view of multiple sheets of prepreg to be stacked together to produce a cover.

The cover 1B is formed from multiple sheets of prepreg p. As shown in FIG. 5 (in this example, seven sheets of prepreg p are used), the prepreg sheets p each cut into a specified shape are stacked together on a mold or core (not shown), and harden by applying heat and pressure thereto. Thereby, the cover 1B is produced.

Then, the cover 1B is bonded to the head main body 1A, preferably by the use of an adhesive agent. Thereby, the club head 1 is produced.

As explained above, the resultant outwardly-increasing gap j between the slant face 14*b* and the edge 1Be of the cover 1B is filled with the adhesive agent. Since the volume of the adhesive agent increases toward the outside, the adhesive agent can effectively absorb the vibrations and shock when hitting a ball.

In this embodiment, as shown in FIG. 2(*b*), the supporting part 14 has an inner end position 14*f* at which the inner surface 4*i* of the main portion 13 of the head main body 1A intersects with the inner surface of the supporting part 14. And the undermentioned thickness ta at the above-mentioned intersection 14*d* is defined as the distance between the intersection 14*d* and the inner end position 14*f*. In the case that the internal corner 14*e* between the inner surface 4*i* of the main portion 13 and the inner surface of the supporting part 14 is formed as a round corner and the inner end position 14*f* is unclear, the inner end position 14*f* can be defined by the position at which a straight line drawn from the intersection 14*d* intersects with the arc of the round corner at a right angle.

The thickness ta at the intersection 14*d* is preferably set in a range of not less than 0.5 mm, more preferably not less than 0.7 mm, but not more than 1.5 mm, more preferably not more than 1.3 mm. If the thickness ta is more than 1.5 mm, the rigidity is increased in the vicinity of the intersection 14*d*, and there is a possibility that the peripheral edge part 15 of the cover 1B is damaged by the vibrations and shock when hitting a ball. If the thickness ta of the intersecting point is less than 0.5 mm, there is a possibility that the supporting part 14 is broken.

For similar reasons, the thickness ta at the intersection 14*d* is preferably set in a range of not less than 0.8 times, more preferably not less than 1.0 times, but not more than 1.8 times, more preferably not more than 1.6 times the thickness tb measured at the edge 14*g* of the supporting part 14 adjacent to the crown opening M as shown in FIG. 2(*b*).

Given that the rigidity index GA of the peripheral edge part 15 of the cover 1B is defined as a product of the tensile strength σ1 of the cover 1B and the thickness t1 of the peripheral edge part 15 supported by the supporting part 14 of the cover 1B, and the rigidity index GB of the supporting part 14 of the head main body 1A is defined as a product of the tensile strength σ2 of the supporting part 14 and the thickness t2 of the supporting part 14, the rigidity index GA is preferably set in a range of not less than 45%, more preferably not less than 50%, but not more than 80%, more preferably not more than 75% of the rigidity index GB. If the ratio GA/GB becomes less than 45% or more than 80%, there is a possibility that the durability is decreased in the vicinity of the junction between the head main body 1A and cover 1B.

Comparison Tests

Based on the structure shown in FIGS. 1 to 4, golf club heads (Lie 57.5 deg. Loft 11 deg., volume 460 cc) having specifications shown in Table 1 were made and tested for the durability in order to confirm the effect of the present invention.

All of the golf club heads had the same specifications except for those shown in Table 1.

Common specifications are as follows:—

Thickness t of face plate 8A: 3.3 mm

Thickness t1 of cover: 1.3 mm

Materials and Making Methods

Crown member: Rolled sheet metal of Ti-4111 press forming

Face member: Rolled sheet metal of Ti-6Al-4V press forming

Sole side member: Rolled sheet metal of Ti-4111 press forming

Hosel member: Round-bar of pure titanium cutting (NC lathe)

cover: Fiber reinforced resin stacking and hardening multiple prepreg sheets

Joining Methods

Members of head main body: welding

Head main body and cover: adhesive agent

Durability Test

Each of the club heads was attached to a carbon shaft (sv-3003J, flex X, produced by SRI sports Limited) and 45-inch wood clubs were prepared. Then, each club was mounted on a swing robot ("SHOTROBO IV" produced by Miyamae corp.), and hit golf balls repeatedly up to 10000 hits at the sweet spot of the club face at the head speed of 54 m/s while checking for damage every 100 hits. And if damage was found, the number of hits was recorded. The results are shown in Table 1, wherein the number "10000" means that no damage was found after the 10000 hits.

Mass of Crown Member

In Table 1, the mass of the crown member of the golf club Ex.m (m: an integer) is indicated as a percentage based on the mass of the crown member of the golf club head Ref.n (n: an integer) having the same design thickness tb' as that of Ex.m.

From the test results, it was confirmed that the golf club heads produced according to the present invention can be improved in the durability. Further, according to the present invention, it is possible to reduce the mass of the crown member, therefore, the design freedom of the center of gravity of the head and the like can be increased.

TABLE 1

| Club head | Ref. 1 | Ref. 2 | Ref. 3 | Ref. 4 | Ref. 5 | Ref. 6 | Ex. 1 |
|---|---|---|---|---|---|---|---|
| First workpiece *1 | | | | | | | |
| Manufacturing method | C | C | C | C | C | C | P |
| Mass | — | 100 | 100 | 100 | 100 | 100 | — |
| Thickness of supporting part | | | | | | | |
| Actual value tb (mm) measured at edge 14g adjacent to opening | — | 0.6 | 0.7 | 0.8 | 1.16 | 1.35 | 0.30 |
| Design value tb' (mm) | 0.3 | 0.5 | 0.6 | 0.7 | 1.0 | 1.2 | 0.3 |
| Value ta (mm) measured at intersection 14d | — | 1.3 | 1.32 | 1.41 | 1.70 | 2.00 | 0.42 |
| ta/tb | — | 2.17 | 1.89 | 1.76 | 1.47 | 1.48 | 1.40 |
| Rigidity index ratio GA/GB | — | 1.30 | 1.10 | 1.01 | 0.85 | 0.83 | 0.56 |
| Durability | — | 2400 | 7700 | 10000 | 10000 | 10000 | 1500 |

| Club head | Ex. 2 | Ex. 3 | Ex. 4 | Ex. 5 | Ex. 6 | Ex. 7 |
|---|---|---|---|---|---|---|
| First workpiece *1 | | | | | | |
| Manufacturing method | P | P | P | P | P | P |
| Mass | 95 | 96 | 96 | 91 | 87 | 93 |
| Thickness of supporting part | | | | | | |
| Actual value tb (mm) measured at edge 14g adjacent to opening | 0.52 | 0.63 | 0.73 | 1.03 | 1.21 | 0.85 |
| Design value tb' (mm) | 0.5 | 0.6 | 0.7 | 1.0 | 1.2 | 0.8 |

TABLE 1-continued

| | | | | | | |
|---|---|---|---|---|---|---|
| Value ta (mm) measured at intersection 14d | 0.66 | 0.77 | 0.85 | 1.26 | 1.53 | 0.70 |
| ta/tb | 1.27 | 1.22 | 1.16 | 1.22 | 1.26 | 0.82 |
| Rigidity index ratio GA/GB | 0.53 | 0.51 | 0.49 | 0.50 | 0.51 | 0.45 |
| Durability | 7400 | 10000 | 10000 | 10000 | 10000 | 10000 |

Ref. 1: It was impossible to make the crown member by a casting technique because the design value tb' of 0.3 mm thickness was too thin.
*1 P: press forming, C: casting

The invention claimed is:

1. A method for producing a golf club head having a hollow structure and including:

a head main body that is made of a metal material and has an opening; and a cover that is provided to cover the opening of the head main body and is made of a low-specific-gravity material having a lower specific gravity than the metal material, the method comprising a step of preparing a first workpiece having the opening, the step of preparing a first workpiece including pressing a sheet material having a uniform thickness to form a supporting part around the opening, the supporting part being recessed stepwise from a head finished surface for supporting a peripheral edge portion of the cover, wherein a rigidity index GA of the cover which is defined as a product of a tensile strength $\sigma$1 of the cover and the thickness t1 of the cover measured in the peripheral edge part supported by the supporting part is 0.45 to 0.80 times a rigidity index GB of the supporting part of the head main body which is defined as a product of a tensile strength $\sigma$2 of the supporting part and the thickness t2 of the supporting part.

2. The method according to claim 1, wherein the first workpiece is a crown member that forms a crown portion defining the upper surface of the golf club head and has an opening in the crown portion, and the cover is made of a fiber-reinforced resin material.

3. A method for producing a golf club head having a hollow structure and including:

a head main body that is made of a metal material and has an opening; and a cover that is provided to cover the opening of the head main body and is made of a low-specific-gravity material having a lower specific gravity than the metal material, the method comprising a step of preparing a first workpiece having the opening, the step of preparing a first workpiece including pressing a sheet material having a uniform thickness to form a supporting part around the opening, the supporting part being recessed stepwise from a head finished surface for supporting a peripheral edge portion of the cover, wherein the supporting part of the head main body has:

a supporting face denting from and being parallel with the outer surface of the head main body around the opening; and a slant face extending from said outer surface to said supporting face while inclining to the opening, and the supporting part has a thickness ta of from 0.5 to 1.5 mm at the intersection between the slant face and said outer surface, and the thickness ta is 0.8 to 1.8 times a thickness tb of the supporting part measured at the edge of the supporting face adjacent to the opening.

4. The method according to claim 3, wherein the first workpiece is a crown member that forms a crown portion defining the upper surface of the golf club head and has an opening in the crown portion, and the cover is made of a fiber-reinforced resin material.

* * * * *